US010844686B2

(12) United States Patent
Hallundbæk et al.

(10) Patent No.: US 10,844,686 B2
(45) Date of Patent: Nov. 24, 2020

(54) ANNULAR BARRIER WITH SAFETY METAL SLEEVE

(75) Inventors: Jørgen Hallundbæk, Græsted (DK); Ricardo Reves Vasques, Holte (DK)

(73) Assignee: Welltec Oilfield Solutions AG, Zug (CH)

( * ) Notice: Subject to any disclaimer, the term of this patent is extended or adjusted under 35 U.S.C. 154(b) by 875 days.

(21) Appl. No.: 13/878,609

(22) PCT Filed: Sep. 12, 2012

(86) PCT No.: PCT/EP2012/067819
§ 371 (c)(1),
(2), (4) Date: May 14, 2013

(87) PCT Pub. No.: WO2013/037816
PCT Pub. Date: Mar. 21, 2013

(65) Prior Publication Data

US 2014/0196887 A1 Jul. 17, 2014

(30) Foreign Application Priority Data

Sep. 13, 2011 (EP) ..... 11181068

(51) Int. Cl.
*E21B 33/127* (2006.01)

(52) U.S. Cl.
CPC ..... *E21B 33/1277* (2013.01); *E21B 33/127* (2013.01)

(58) Field of Classification Search
CPC ..... E21B 33/1277; E21B 33/127
(Continued)

(56) References Cited

U.S. PATENT DOCUMENTS 2,098,484 A * 11/1937 Brundred ..... E21B 33/1277 277/331
4,768,590 A * 9/1988 Sanford ..... E21B 33/1277 166/187
(Continued)

FOREIGN PATENT DOCUMENTS

CN 1624293 A 6/2005
CN 101532600 A 9/2009
(Continued)

OTHER PUBLICATIONS

International Preliminary Report on Patentability issued in International Application No. PCT/EP2012/067819 dated Mar. 18, 2014.
(Continued)

*Primary Examiner* — George S Gray
(74) *Attorney, Agent, or Firm* — Nixon & Vanderhye P.C.

(57) ABSTRACT

An annular barrier is expandable in an annulus between a well tubular structure and an inside wall of a borehole downhole for providing zone isolation between a first zone and a second zone of the borehole. The annular barrier has a tubular part for mounting as part of the well tubular structure, an expandable metal sleeve surrounding the tubular part and having an inner face facing the tubular part and an outer face facing towards the inside wall of the borehole, each end of the expandable metal sleeve being connected with a connection part which is connected with the tubular part, a space between the inner face of the expandable metal sleeve and the tubular part, and an expansion opening in the tubular part through which fluid may enter into the space in order to expand the expandable metal sleeve. The annular barrier also has a first safety metal sleeve surrounding the tubular part and abutting the expandable metal sleeve and the first safety metal sleeve having a first inner face abutting the face of the expandable metal sleeve, each end of the first
(Continued)

safety metal sleeve being connected with the connection part which is connected with the tubular part.

22 Claims, 9 Drawing Sheets

(58) Field of Classification Search
USPC ..... 166/187; 271/334; 277/334
See application file for complete search history.

(56) References Cited

U.S. PATENT DOCUMENTS

| | | | | |
|---|---|---|---|---|
| 4,967,846 | A * | 11/1990 | Wood | F16J 15/46 166/187 |
| 5,327,962 | A * | 7/1994 | Head | E21B 33/1277 166/187 |
| 5,507,345 | A | 4/1996 | Wehunt, Jr. et al. | |
| 6,640,893 | B1 * | 11/2003 | Rummel | E21B 33/1208 166/187 |
| 7,234,533 | B2 | 6/2007 | Gambier | |
| 2005/0072579 | A1 * | 4/2005 | Gambier | E21B 33/1277 166/387 |
| 2005/0161232 | A1 | 7/2005 | Patel et al. | |
| 2006/0027371 | A1 * | 2/2006 | Gorrara | E21B 33/127 166/313 |
| 2006/0027374 | A1 | 2/2006 | Gorrara | |
| 2006/0042801 | A1 | 3/2006 | Hackworth et al. | |
| 2009/0255691 | A1 * | 10/2009 | Loughlin | E21B 33/127 166/387 |
| 2011/0075978 | A1 * | 3/2011 | Rose | H01B 3/302 385/102 |

FOREIGN PATENT DOCUMENTS

| | | | |
|---|---|---|---|
| EP | 1 624 152 | A2 | 2/2006 |
| EP | 2 206 879 | A1 | 7/2010 |
| EP | 2 312 119 | A1 | 4/2011 |
| EP | 2 479 376 | A1 | 7/2012 |
| RU | 6406 | U1 | 4/1998 |
| RU | 2128279 | C1 | 3/1999 |
| RU | 2224872 | C1 | 2/2004 |
| RU | 2249669 | C1 | 4/2005 |

OTHER PUBLICATIONS

Notice of Opposition to a European Patent filed Jul. 10, 2014 in European Patent No. 2570587 (5 pages).
International Search Report for PCT/EP2012/067819, dated Nov. 12, 2012, 4 pages.
Written Opinion of the International Searching Authority for PCT/EP2012/067819, dated Nov. 12, 2012, 7 pages.
Notification on the Results of Patentability Examination of an Invention dated Oct. 21, 2016 in Russian Application No. 2014111784/03(018577), with English Translation (10 pages).
Ivanovski, V.N., College Textbook, "CentrNefteGas," 1.9. Downhole Seal Assemblies—Packers, 2006, p. 53, with English Translation (2 pages).
Decision to Grant issued in related Russian Application No. 2014111784/03(018577), with English translation, dated Jun. 8, 2017 (18 pages).
Brief Communication dated Mar. 16, 2017 in European Patent No. 2570587 (1 page), including Opponent's letter filed on Mar. 10, 2017 (2 pages).
Dreesen, D.S., "Analytical and Experimental Evaluation of Expanded Metal Packers for Well Completion Service," SPE 22858, Society of Petroleum Engineers, Annual Conference and Exhibition of the Society of Petroleum Engineers, Oct. 6-9, 1991, pp. 413-421.

* cited by examiner

ANNULAR BARRIER WITH SAFETY METAL SLEEVE

This application is the U.S. national phase of International Application No. PCT/EP2012/067819, filed 12 Sep. 2012, which designated the U.S. and claims priority to EP Application No. 11181068.5, filed 13 Sep. 2011, the entire contents of each of which are hereby incorporated by reference.

FIELD OF THE INVENTION

The present invention relates to an annular barrier to be expanded in an annulus between a well tubular structure and an inside wall of a borehole downhole for providing zone isolation between a first zone and a second zone of the borehole.

BACKGROUND ART

In wellbores, annular barriers are used for different purposes, such as for providing an isolation barrier. An annular barrier has a tubular part mounted as part of the well tubular structure, such as the production casing, which is surrounded by an annular expandable sleeve. The expandable sleeve is typically made of an elastomeric material or metal. The sleeve is fastened at its ends to the tubular part of the annular barrier.

In order to seal off a zone between a well tubular structure and the borehole or an inner and an outer tubular structure, a second annular barrier is used. The first annular barrier is expanded on one side of the zone to be sealed off, and the second annular barrier is expanded on the other side of that zone, and in this way, the zone is sealed off.

The pressure envelope of a well is governed by the burst rating of the tubular and the well hardware etc. used within the well construction. In some circumstances, the expandable sleeve of an annular barrier may be expanded by increasing the pressure within the well, which is the most cost-efficient way of expanding the sleeve.

Expanding the expandable sleeve by increasing the pressure within the well requires a high expansion pressure. Using such a high expansion pressure applies great stressing forces to the expandable sleeve, and the expandable sleeve may rupture during expansion. The rupture of an expandable sleeve is very undesirable since the outside of the well casing, i.e. the borehole environment, becomes fluidly connected with the inside of the well casing, thereby polluting the production fluid, e.g. crude oil, with fluids containing less oil, e.g. drilling mud.

Expanded annular barriers may be subjected to a continuous pressure or a periodic high pressure from the outside, either in the form of hydraulic pressure within the well environment or in the form of formation pressure. In some circumstances, such pressure may cause the annular barrier to collapse, which may have consequences for the area which is to be sealed off by the barrier as the sealing properties are lost due to the collapse. Therefore, annular barriers are designed to withstand large pressure to avoid collapse. The ability of the expanded sleeve of an annular barrier to withstand the collapse pressure is referred to as the collapse rating.

The ability of the expanded sleeve of an annular barrier to withstand both the expansion pressure during expansion of the annular barrier and withstand the collapse pressure during the lifetime of the annular barrier, which may easily exceed 20 years, is thus affected by many variables, such as strength of material, wall thickness, surface area exposed to the collapse pressure, temperature, well fluids, etc. To increase resistance against rupture and collapse of the annular barrier, expandable sleeves are therefore conventionally made thicker and even braced with bracing elements to avoid collapse. However, rupture of the expandable sleeve typically arises due to irregularities in the material leading to a "weak area" on the expandable sleeve, and therefore even the strongest expandable sleeves being expandable by an available expansion pressure in the well may rupture due to these "weak areas". Producing a "perfect" expandable sleeve without any "weak areas" is practically impossible even with modern high standard material synthesis techniques, at least in a scaled production facility producing bulk annular barriers for the oil producing industry.

It is thus desirable to provide a solution wherein the annular barrier is improved so that it does not rupture during expansion or collapse when expanded, without having to increase the thickness of the expandable sleeve to levels where the expandable sleeve cannot be inflated by the available expansion pressure in the well.

SUMMARY OF THE INVENTION

It is an object of the present invention to wholly or partly overcome the above disadvantages and drawbacks of the prior art. More specifically, it is an object to provide an improved annular barrier solution which does not rupture during expansion while still maintaining a required collapse rating.

The above objects, together with numerous other objects, advantages, and features, which will become evident from the below description, are accomplished by a solution in accordance with the present invention by an annular barrier to be expanded in an annulus between a well tubular structure and an inside wall of a borehole downhole for providing zone isolation between a first zone and a second zone of the borehole, comprising

- a tubular part for mounting as part of the well tubular structure,
- an expandable metal sleeve surrounding the tubular part and having an inner face facing the tubular part and an outer face facing towards the inside wall of the borehole, each end of the expandable metal sleeve being connected with a connection part which is connected with the tubular part,
- a space between the inner face of the expandable metal sleeve and the tubular part, and
- an expansion opening in the tubular part through which fluid may enter into the space in order to expand the expandable metal sleeve, wherein the annular barrier further comprises a first safety metal sleeve surrounding the tubular part and abutting the expandable metal sleeve and said first safety metal sleeve having a first inner face abutting the face of the expandable metal sleeve, each end of the first safety metal sleeve being connected with the connection part which is connected with the tubular part.

In one embodiment, the sleeves may have a length, and the first face of the first safety metal sleeve may abut the face of the expandable metal sleeve along the whole length of the expandable metal sleeve.

Moreover, the first safety metal sleeve may have a first inner face abutting the outer face of the expandable metal sleeve.

The annular barrier as described above may further comprise a second safety metal sleeve surrounding the tubular part, the expandable metal sleeve and said second safety metal sleeve having a second inner face facing the safety metal sleeve, each end of the second safety metal sleeve being connected with the connection part which is connected with the tubular part.

Also, the annular barrier as described above may comprise a third safety metal sleeve, said third safety metal sleeve having a third inner face facing the second outer face of the second safety metal sleeve, each end of the third safety metal sleeve being connected with the connection part which is connected with the tubular part.

Further, the annular barrier as described above may comprise a plurality of additional safety metal sleeves surrounding the tubular part and the safety metal sleeves being the first and second safety metal sleeves and being connected with the connection part which is connected with the tubular part.

In addition, the expandable metal sleeve and safety metal sleeve may have different required expansion pressures, i.e. the pressure required to expand one sleeve may be different from sleeve to sleeve.

Moreover, the expandable metal sleeve and safety metal sleeve may be made from different materials.

Said sleeves may have a thickness and the thickness of the expandable metal sleeve may be greater than the thickness of the safety metal sleeve.

Also, the sleeves may have a thickness, the thickness of the first safety metal sleeve being smaller than the thickness of the expandable metal sleeve and greater than the thickness of the second safety sleeve.

Additionally, the sleeves may have a thickness, the thickness of the first safety metal sleeve being smaller than the thickness of the expandable metal sleeve and smaller than the thickness of the second safety sleeve.

Furthermore, the safety metal sleeve may have a higher ductility than the expandable metal sleeve.

The expandable metal sleeve may have a higher yield strength than the safety metal sleeve.

More specifically, the thickness of the expandable metal sleeve may be at least 10% greater than the thickness of the safety metal sleeve(s), preferably at least 15% greater than the thickness of the safety metal sleeve(s), and more preferably at least 20% greater than the thickness of the safety metal sleeve(s).

In an embodiment, the first safety metal sleeve may be made of a material having an elongation of more than 10% of an elongation of the material of the expandable metal sleeve.

Also, one of the safety metal sleeves may be made of a material more ductile than a material of the expandable metal sleeve.

Said expandable metal sleeve may have a length being substantially equal to a length of the first and second sleeves in an unexpanded condition of the annular barrier.

Further, the expandable metal sleeve may be made of a material having a yield strength which is higher than a yield strength of a material of the first and/or second safety metal sleeve.

In addition, the expandable metal sleeve may be made of a material having a yield strength which is at least 10% higher than a yield strength of a material of the first and/or second sleeve, preferably at least 15% higher and more preferably at least 20% higher than a yield strength of the material of the first and/or second sleeve.

Moreover, the expandable metal sleeve may have an unexpanded outside diameter and an expanded outside diameter, the expanded diameter of the expandable metal sleeve being at least 10% larger than the unexpanded diameter, preferably at least 15% larger than the unexpanded diameter, more preferably at least 30% larger than the unexpanded diameter.

The second sleeve may have circumferential elements restricting a free expansion of at least the second safety sleeve.

In an embodiment, the additional sealing element surrounding an outermost safety sleeve may comprise an intermediate layer of elastomer, rubber or polymer arranged between the outermost safety metal sleeve and a sealing element sleeve.

Furthermore, the safety metal sleeve closest to the inside wall of the borehole may be made from a sealing metal material.

Also, the safety metal sleeve closest to the inside wall of the borehole may comprise at least one sealing element.

Finally, the annular barrier according to the present invention may further comprise a protective layer of lames on the outer face of the safety metal sleeve closest to the inside wall of the borehole.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
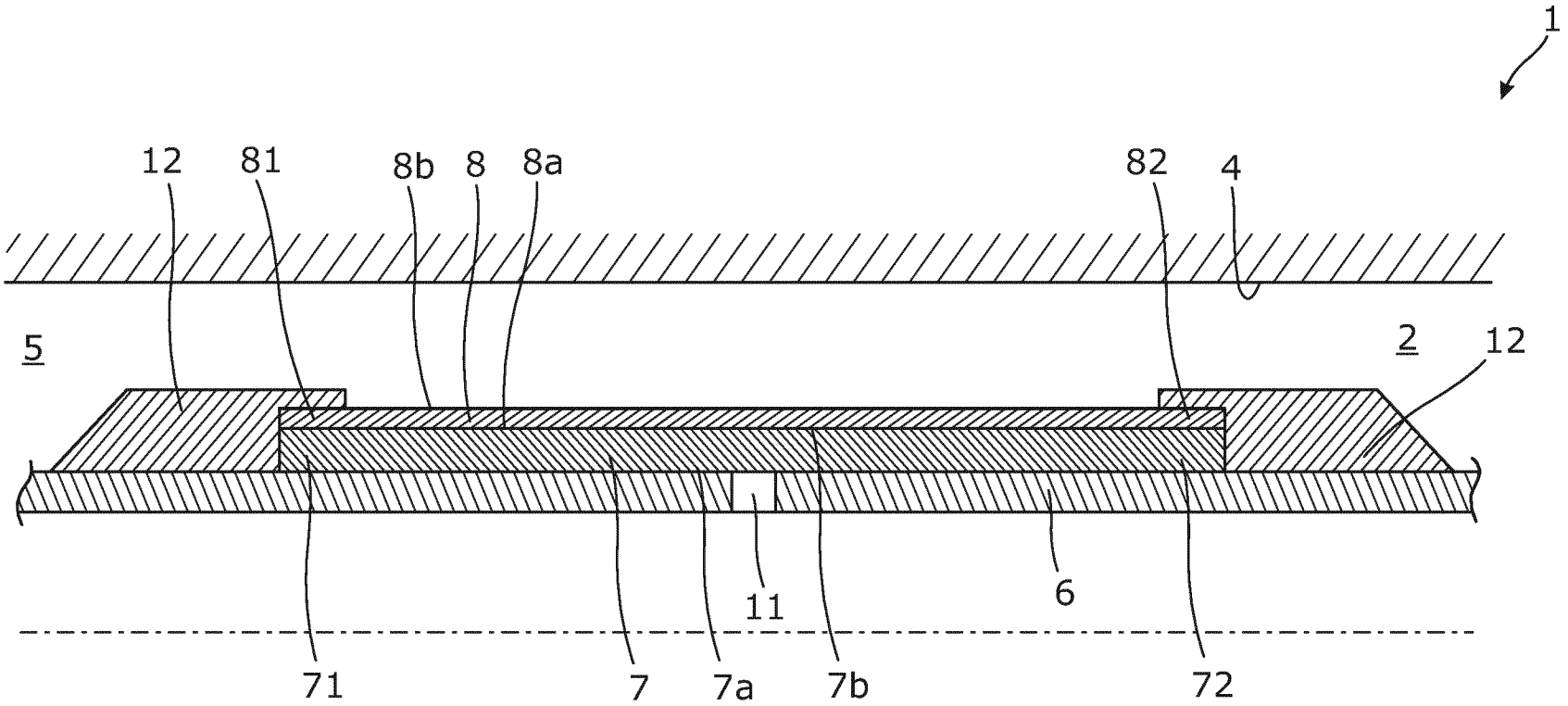
FIG. 1 shows a cross-sectional view along a longitudinal extension of an annular barrier in its unexpanded condition.
Figure 2:
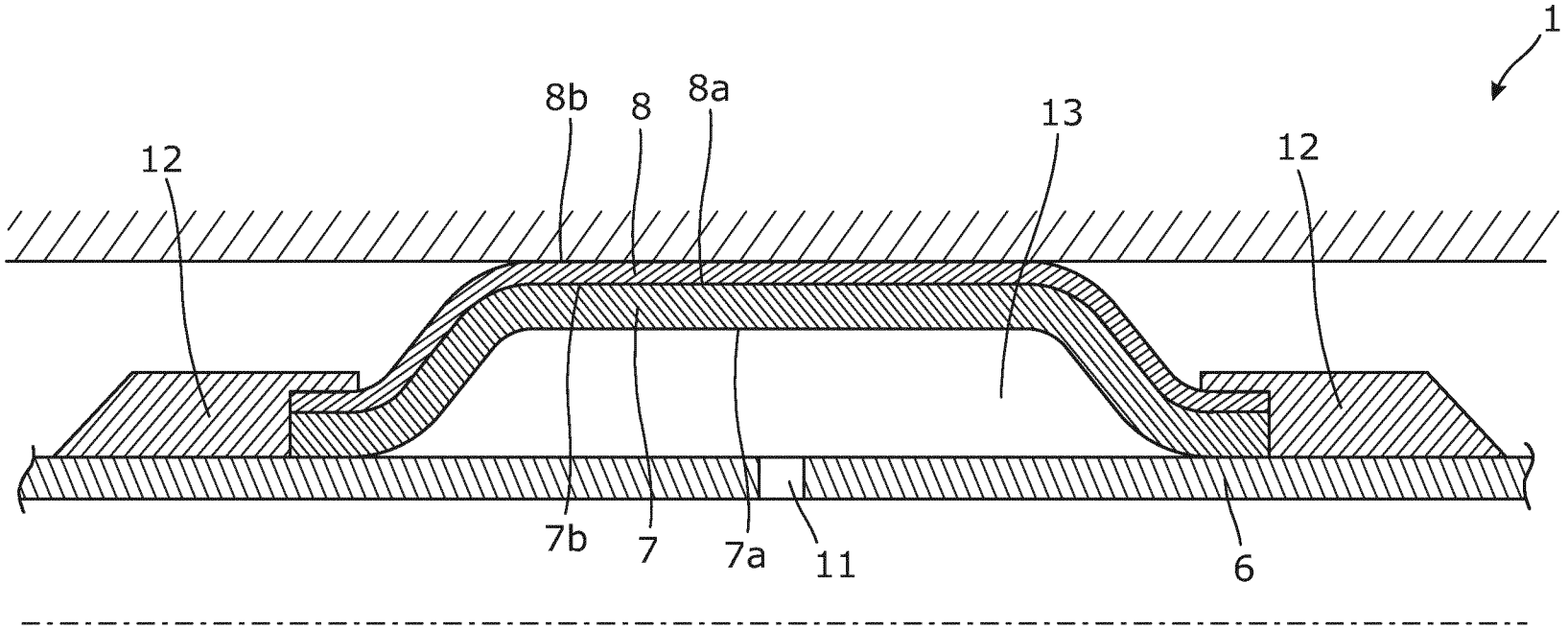
FIG. 2 shows the annular barrier of FIG. 1 in its expanded condition.

FIG. 1 shows a cross-sectional view along a longitudinal extension of an annular barrier 1 in its unexpanded condition. The annular barrier 1 is rotationally symmetric around a centre axis of rotation 18. The annular barrier is to be expanded in an annulus 2 between a well tubular structure 3 and an inside wall 4 of a borehole 5 downhole. FIG. 2 shows the annular barrier of FIG. 1 in its expanded condition, providing zone isolation between a first zone 200 and a second zone 300 of the borehole 5. The annular barrier 1 comprises a tubular part 6 for mounting as part of the well tubular structure and an expandable metal sleeve 7 surrounding the tubular part 6. The expandable metal sleeve has an inner face 7*a* facing the tubular part, and each end 71, 72 of the expandable metal sleeve is connected with a connection part 12 which is connected with the tubular part, thereby defining a space 13 between the inner face of the expandable metal sleeve 7 and the tubular part. The space 13 is defined by the expandable metal sleeve, the connection parts 12 and the tubular part 6. The annular barrier further comprises a first safety metal sleeve 8 surrounding the tubular part and abutting the expandable metal sleeve 7. The first safety metal sleeve has a first inner face 8*a* abutting an outer face 7*b* of the expandable metal sleeve, and each end 81, 82 of the first safety metal sleeve is connected with the connection part 12 which is connected with the tubular part. The tubular part 6 comprises an expansion opening 11 for allowing fluid to enter the space 13 during expansion of the annular barrier 1. The inner face of the first safety metal sleeve 8 abuts and contacts the face of the expandable metal sleeve along the whole length of the expandable metal sleeve in its unexpanded condition. In the expanded condition and the unexpanded condition, the outer face 8*b* of the first safety metal sleeve abuts the inner wall of the borehole and during expansion, the safety metal sleeve limits the free movement of the expandable metal sleeve. Furthermore, the force applied to the expandable metal sleeve 7 is transferred to the safety metal sleeve 8 by means of the expandable metal sleeve, resulting in a more even distribution of the force applied on the safety metal sleeve than when applied on the expandable metal sleeve.

Figure 3:
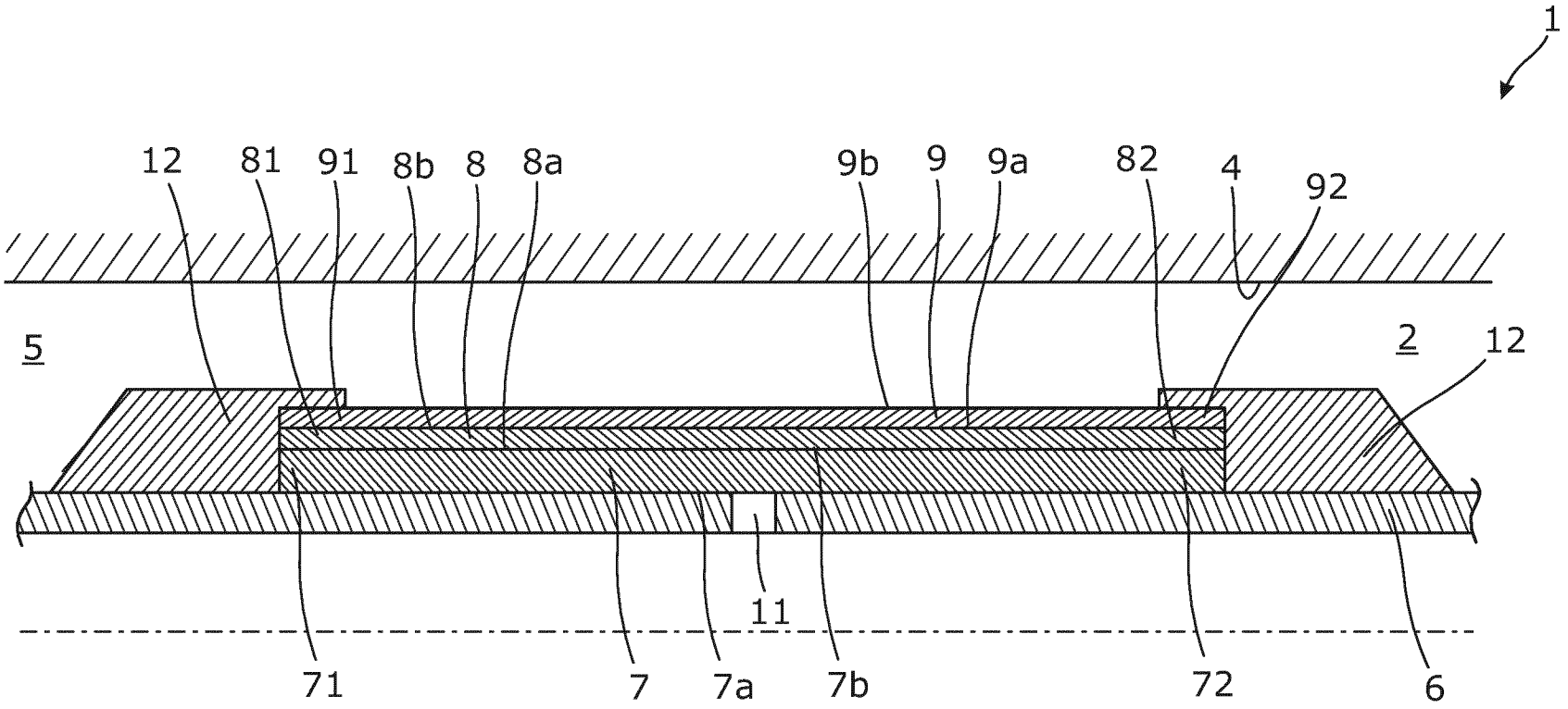
FIG. 3 shows a cross-sectional view along a longitudinal extension of another embodiment of the annular barrier in its unexpanded condition comprising a second safety metal sleeve.
Figure 4:
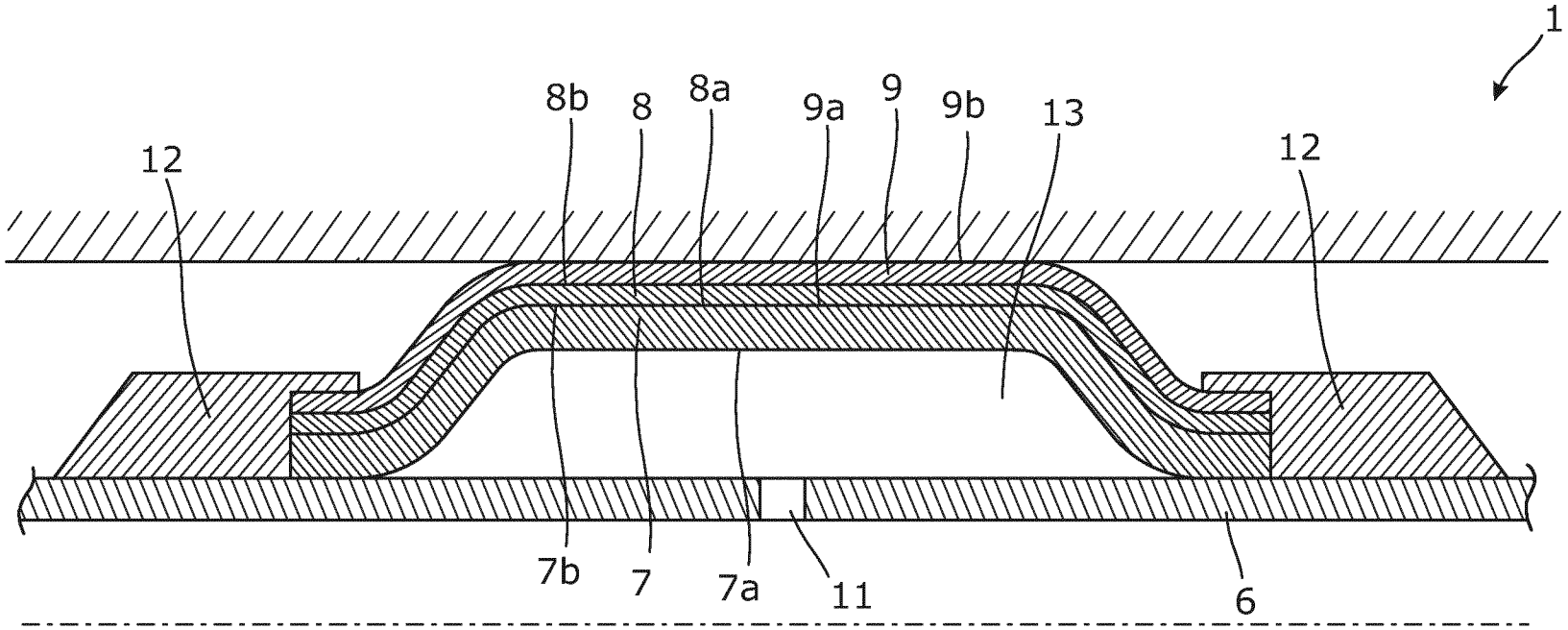
FIG. 4 shows the annular barrier of FIG. 3 in its expanded condition.

FIG. 3 shows a cross-sectional view along a longitudinal extension of an annular barrier 1 condition further comprising a second safety metal sleeve 9 surrounding the tubular part, the expandable metal sleeve 7 and the first safety metal sleeve 8. The second safety metal sleeve 9 has a second inner face 9*a* facing the first safety metal sleeve 8, and each end 91, 92 of the second safety metal sleeve 9 is connected with the connection part 12 which again is connected with the tubular part. The tubular part 6 comprises an expansion opening 11 for allowing fluid to enter the space 13 during expansion of the annular barrier 1. FIG. 4 shows the annular barrier of FIG. 3 in its expanded condition, providing zone isolation between a first zone 200 and a second zone 300 of the borehole 5.

Figure 5:
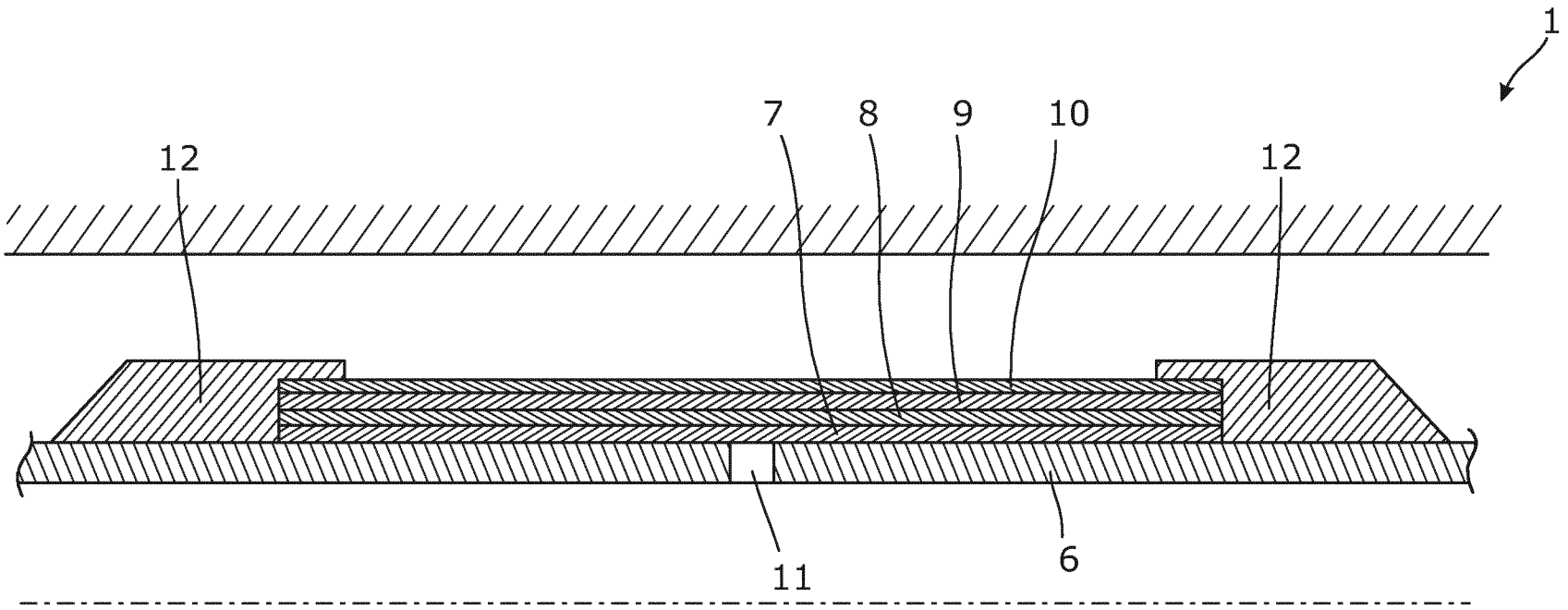
FIG. 5 shows a cross-sectional view along a longitudinal extension of another embodiment of the annular barrier in its unexpanded condition further comprising a third safety metal sleeve.

FIG. 5 shows an annular barrier further comprising an additional safety metal sleeve 10. The annular barrier 1 shown in FIG. 5 comprises one additional safety metal sleeve 10, the first and second safety metal sleeve 8, 9 and the expandable metal sleeve 7, but even more additional safety metal sleeves may be added to avoid ruptures of the annular barrier.

When using several additional safety metal sleeves such as shown in FIG. 5, the annular barrier may be optimised by using safety metal sleeves with different required expansion pressures, so that peripheral sleeves have lower required expansion pressures than more central sleeves. If the safety metal sleeves have lower required expansion pressures, e.g. because they are thinner than the expandable metal sleeve such as shown in FIGS. 1 and 2, the pressure required to expand the annular barrier may be lowered. Instead of changing the thickness of the safety metal sleeves and the expandable metal sleeve, the sleeves may be made from different materials to provide a difference in required expansion pressure, e.g. one sleeve may be designed to require a smaller expansion pressure than another sleeve by using two different materials. Furthermore, the use of different materials may be used to provide a very ductile material in the outermost sleeves to inhibit necking in the outermost sleeves during expansion. On the other hand, the innermost sleeves, such as the expandable metal sleeve and the first safety metal sleeve, may be made from a less ductile material, which may resist a larger external pressure from the outside of the annular barrier, e.g. sudden changes in the borehole pressure. Since the outermost sleeves are supported by the innermost sleeves when a pressure is applied from the outside, the ability of the innermost sleeves to resist such pressures are important when requiring an annular barrier with a high collapse pressure.

The thickness of the expandable metal sleeve shown in FIG. 5 is substantially reduced compared to the expandable metal sleeves shown in FIGS. 1-4. When the number of safety metal sleeves is increased, the overall strength of the annular barrier is increased, and the thickness of the expandable metal sleeve 7 may be decreased in order to reduce the total thickness of the sleeves.

An annular barrier may comprise several additional safety metal sleeves 10, such as three additional safety metal sleeves 10, such as four additional safety metal sleeves 10, such as five additional safety metal sleeves 10, or even more additional safety metal sleeves.

Figure 6A:
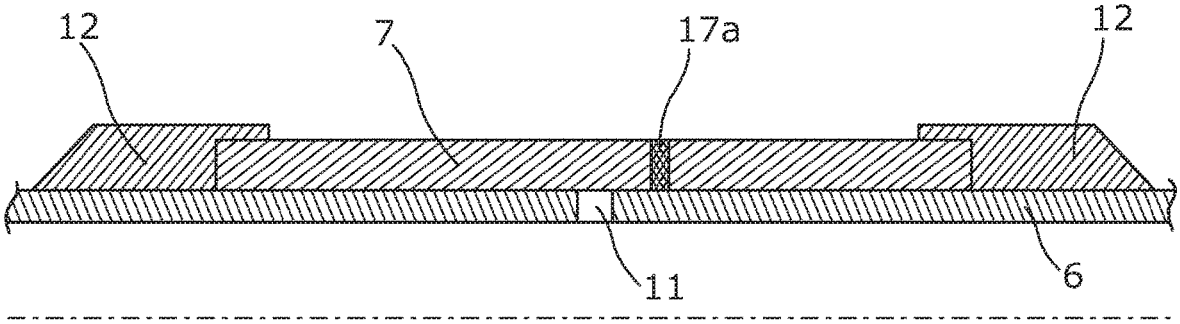
Fig. 6a PRIOR ART
FIG. 6*a* shows a cross-sectional view along a longitudinal extension of a known annular barrier comprising one expandable metal sleeve in its unexpanded condition.
Figure 6B:
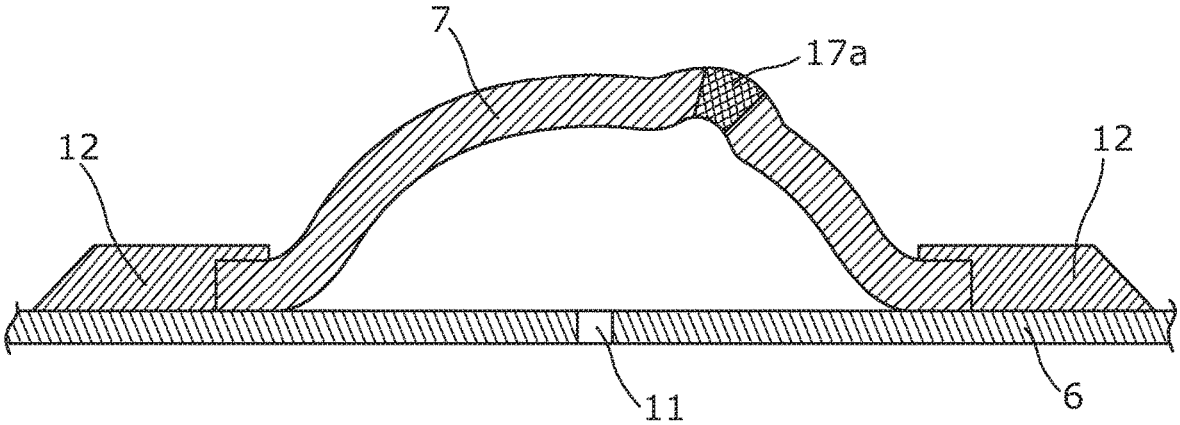
Fig. 6b PRIOR ART
FIG. 6*b* shows the known annular barrier of FIG. 6*a* in an intermediate condition during expansion of the annular barrier.
Figure 6C:
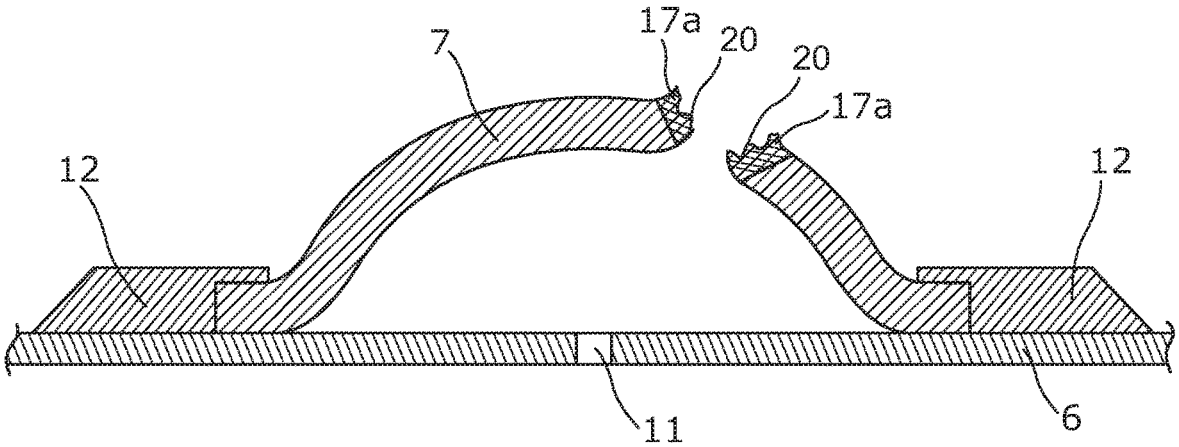
Fig. 6c PRIOR ART
FIG. 6*c* shows the known annular barrier of FIGS. 6*a* and 6*b* in an expanded condition comprising a ruptured expandable metal sleeve.

FIGS. 6*a*-6*c* show a known annular barrier comprising an expandable metal sleeve 7 with no safety metal sleeves. The expandable metal sleeve 7 has a weak area 17*a*, e.g. a thinning, an area with one or more fractures, an area with reduced strength due to material composition, and/or an area with impurities. When the annular barrier having such a weak area is expanded, the expandable metal sleeve starts to deform more rapidly around the weak area 17*a* and bulge due to the reduced strength in this weak area, as shown in FIG. 6*b*. The more rapid expansion of the material around the weak area leads to the creation of a "bubble" on the expandable metal sleeve 7 near the weak area. Since the material around the weak area expands more rapidly than the rest of the material of the expandable metal sleeve, the expandable metal sleeve thins in this area and is more likely to have a fracture 20 near the weak area 17*a*, leading to at least a local rupture if not a circumferential rupture of the annular barrier as illustrated in FIG. 6*c*.

Figure 7A:
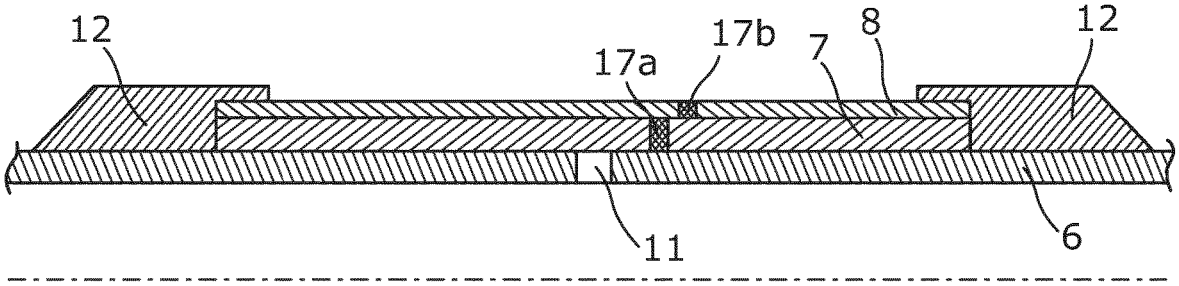
FIG. 7*a* shows a cross-sectional view along a longitudinal extension of another embodiment of the annular barrier comprising an expandable metal sleeve and a first safety sleeve in its unexpanded condition.
Figure 7B:
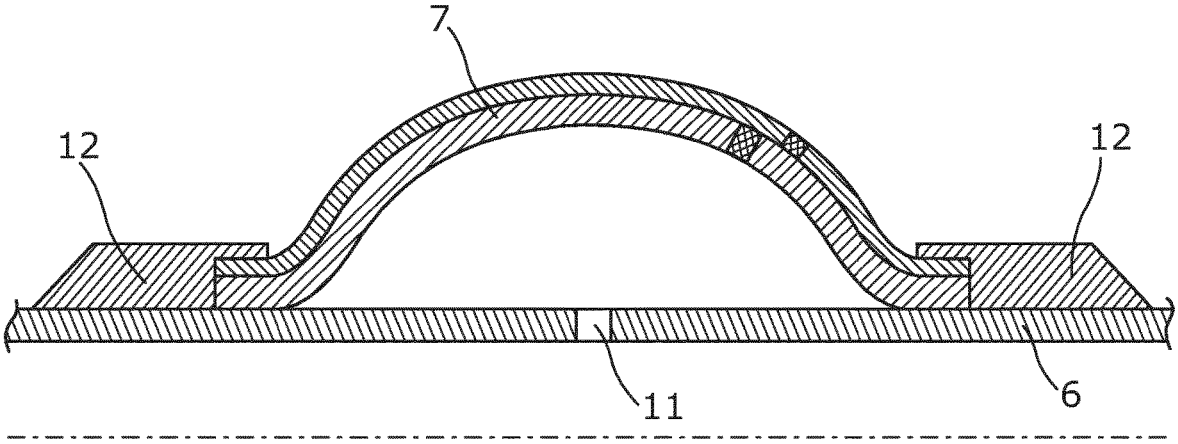
FIG. 7*b* shows the annular barrier of FIG. 7*a* in an intermediate condition during expansion of the annular barrier.
Figure 7C:
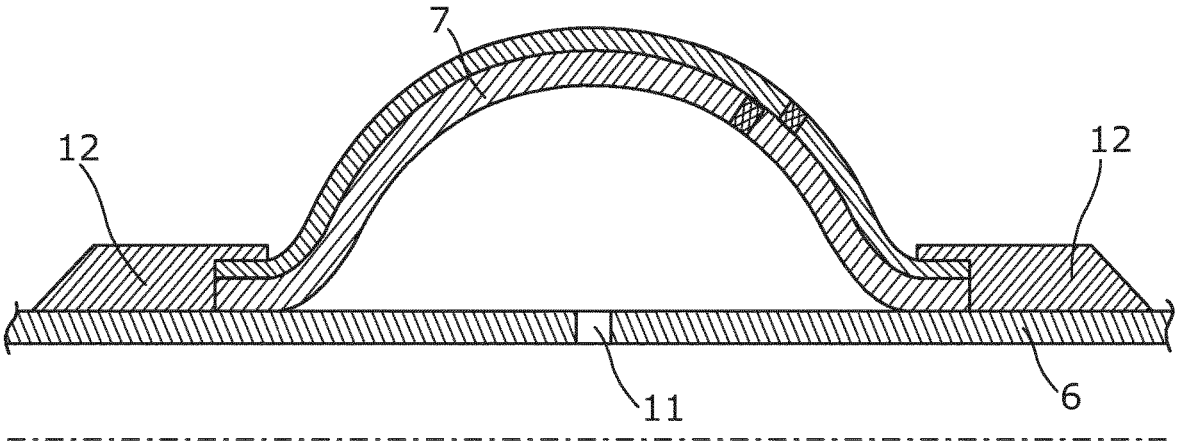
FIG. 7*c* shows the annular barrier of FIGS. 7*a* and 7*b* in an expanded condition.

FIGS. 7*a*-7*c* show an annular barrier comprising an expandable metal sleeve 7 and a first safety metal sleeve 8. As shown in FIG. 7*a*, the expandable metal sleeve 7 has a weak area 17*a*, which is most likely to occur during the manufacturing process of making the expandable metal sleeve. Even though the first safety metal sleeve also has a weak area 17*b*, it is not likely to be arranged opposite the weak area of the expandable metal sleeve. When the annular barrier shown in FIG. 7*a* is expanded as shown in FIG. 7*b*, the safety metal sleeve 8 braces and supports the weak area 17*a* of the expandable metal sleeve so that it cannot bulge and form a bubble 21, such as the one shown in FIG. 6*b*. In this way, the safety metal sleeve prevents the expandable metal sleeve from moving freely but controls the expansion process of the expandable metal sleeve to occur more evenly. Furthermore, the force from the expansion fluid in the space 13 will be applied on the inner face 7*a* of the expandable metal sleeve 7, and since the safety metal sleeve abuts the expandable metal sleeve, the force on the safety metal sleeve will be applied by the expandable metal sleeve directly. Therefore, should the safety metal sleeve 8 comprise a weak area 17*b*, the part of the expandable metal sleeve close to the weak area will brace the weak area 17*b* of the safety metal sleeve so that a bubble is not formed on the safety metal sleeve as well. The force on the safety metal sleeve is distributed evenly to the safety metal sleeve by means of the expandable metal sleeve, and thus no force will be applied to a part of the safety metal sleeve which is not in contact with the expandable metal sleeve until the expandable metal sleeve is once again in contact with that part of the safety metal sleeve. Thus, no bulging of the safety metal sleeve can occur as no force will be applied to the somewhat bulging part, resulting in a subsequent burst of the safety metal sleeve.

The safety metal sleeve of FIGS. 7*a*-7*b* is thinner than the expandable metal sleeve, e.g. the safety metal sleeve may be 0.5-1.0 mm and the expandable metal sleeve may be 5-10 mm and thus, by adding only a thin outer sleeve, the risk of fracturing the expandable metal sleeve during expansion is substantially reduced without substantially increasing the overall thickness of the annular barrier.

Figure 8A:
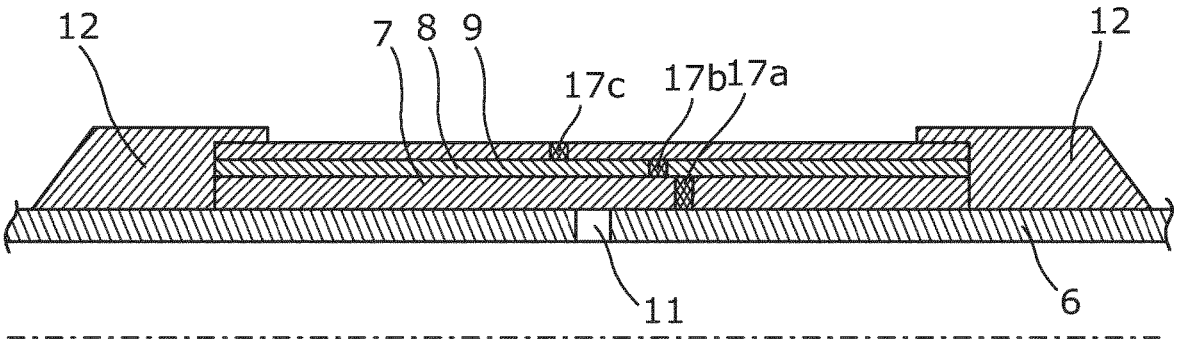
FIG. 8*a* shows a cross-sectional view along a longitudinal extension of another embodiment of the annular barrier comprising an expandable metal sleeve, a first safety sleeve and a second safety metal sleeve in its unexpanded condition.
Figure 8B:
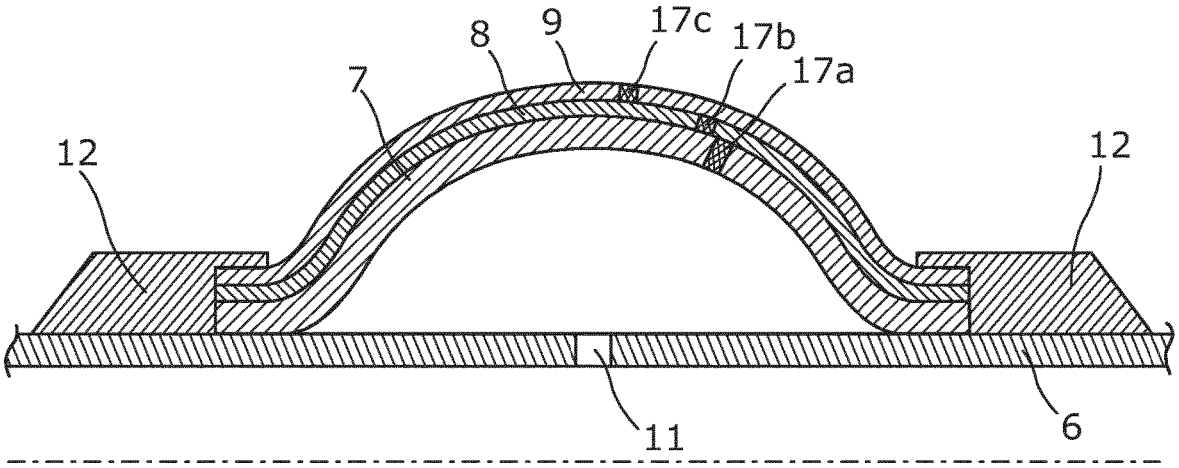
FIG. 8*b* shows the annular barrier of FIG. 8*a* in an intermediate condition during expansion of the annular barrier.
Figure 8C:
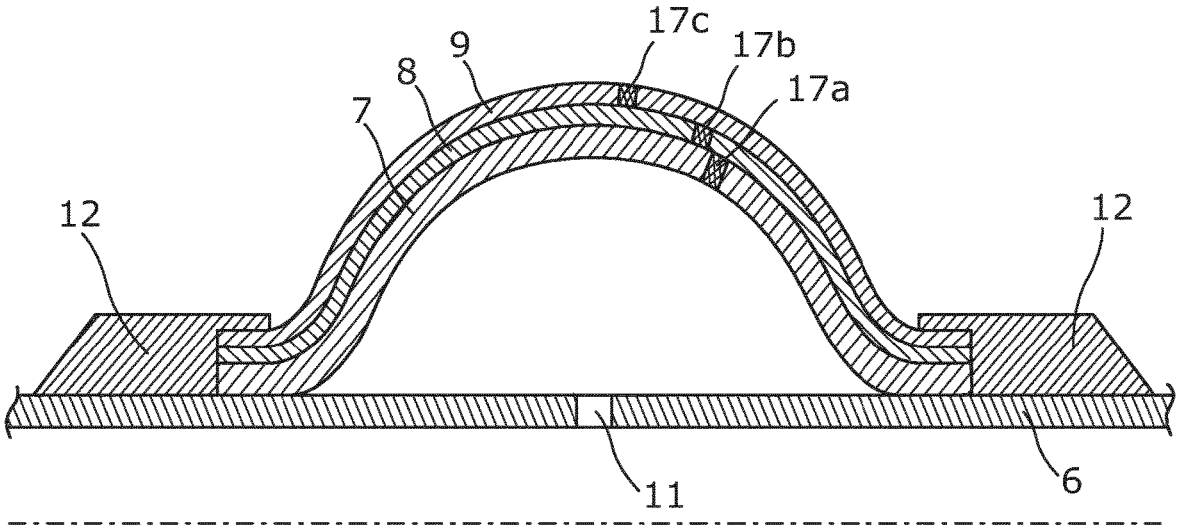
FIG. 8*c* shows the annular barrier of FIGS. 8*a* and 8*b* in an expanded condition.

FIGS. 8*a*-8*c* show an annular barrier comprising an expandable metal sleeve 7, a first safety metal sleeve 8 and a second safety metal sleeve 9. As shown in FIG. 8*a*, the expandable metal sleeve 7 has a weak area 17*a*, and the first safety metal sleeve 8 has a weak area 17*b* and the second safety metal sleeve 9 has a weak area 17*c*. Increasing the number of safety metal sleeves reduces the risk of all sleeves having a weak area close to each other. If all sleeves have a weak area close to each other, the situation resembles the situation shown in FIG. 6*a* where only one sleeve comprising a weak area constitutes the expandable part of the annular barrier. Therefore, providing a safety metal sleeve substantially reduces the risk of rupturing the expandable metal sleeve during expansion, and the addition of more safety metal sleeves even further minimises this risk. Having an annular barrier, where the expandable metal sleeve 7 has a weak area 17*a* close to or even spot on a weak area 17*b* on the first safety metal sleeve, the two inner sleeves, i.e. the expandable metal sleeve and the first safety metal sleeve, are still braced by the second safety metal sleeve to ensure that a "bubble" is not formed. Since the annular barrier has a large surface area and the weak areas of the sleeves with modern production techniques are typically very small and widely spread on this large surface area, the risk of two overlapping weak areas is very small. However, adding one more safety metal sleeves as shown in FIGS. 8*a*-8*c* or even a third safety metal sleeve as shown in FIG. 5 almost eliminates the risk of overlapping weak areas, since the probability may typically be lowered by several orders of magnitude for every additional safety metal sleeve.

Figure 9:
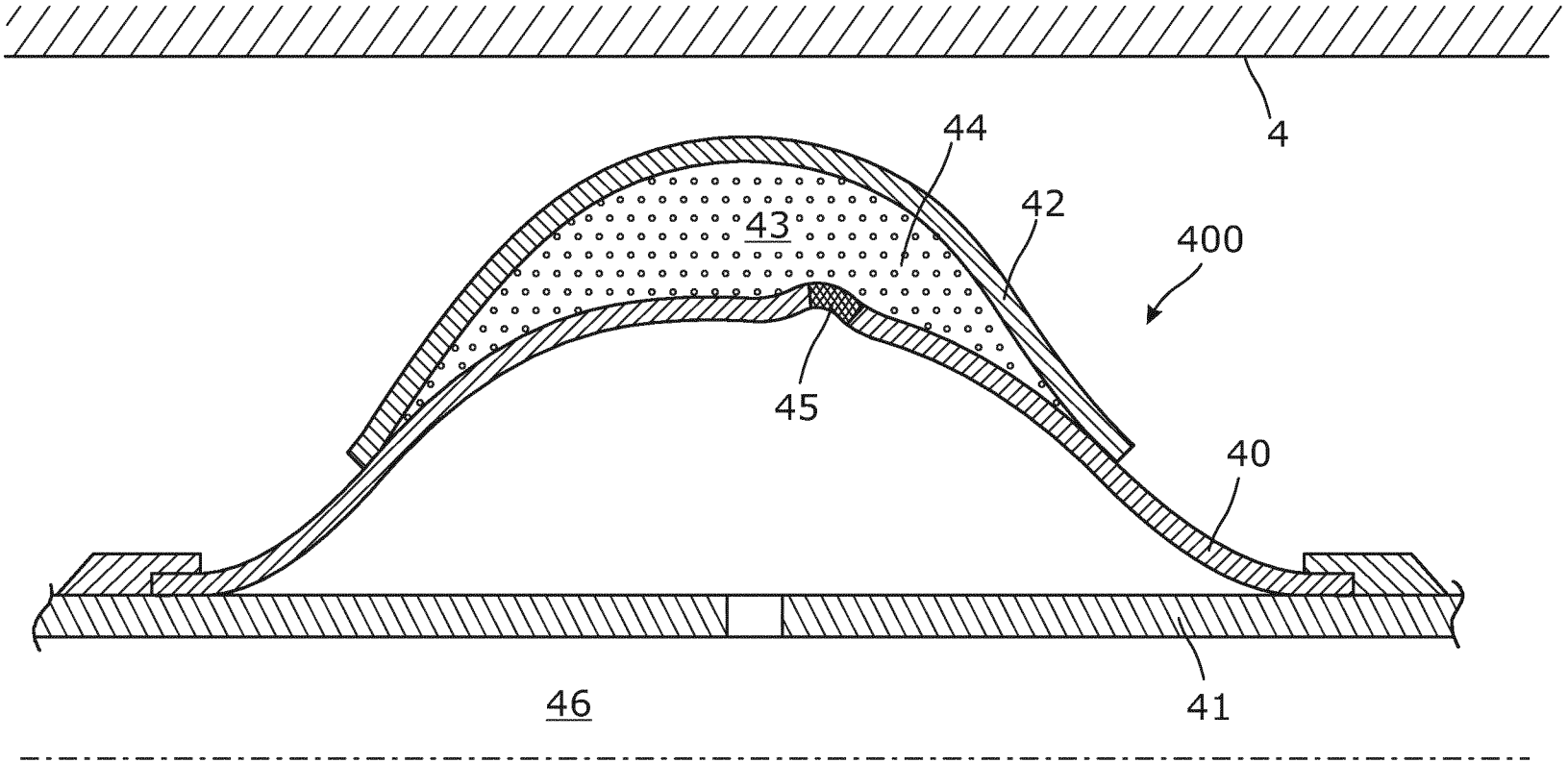
FIG. 9 shows a known annular barrier comprising a sealing element.

FIG. 9 shows a known barrier 400 comprising an expandable metal sleeve member 40 surrounding a tubular section 41 and a further outer sleeve member 42 partially surrounding the expandable metal sleeve member 40 and enclosing a space 43 filled with a sealing material 44 such as a polymeric material. This is a known solution thought to provide better sealing between the inside wall 4 of the borehole and an inside of the production casing 46. However, as shown in FIG. 9, if the expandable metal sleeve member comprises a weak area 45, the expandable metal sleeve member 40 may still rupture during expansion, since a bubble or bulging may start to form within the space 43 and displace the polymeric material and eventually lead to a fracture in the sealing expandable metal sleeve member 40. The collapse strength of the expandable metal sleeve member is thus substantially reduced. As the polymeric material leaves the space 43 through the opening in the further outer sleeve member, the barrier leaks since the pressurised fluid expanding the expandable metal sleeve member will force its way through the polymeric material and out through the opening, and a seal will never be formed.

The annular barrier of the present invention may be improved with respect to sealing properties towards the inside wall 4 of the borehole by adding an additional sealing element surrounding an outermost safety sleeve, which comprises an intermediate layer of elastomer, rubber or polymer arranged between the outermost safety metal sleeve and a sealing element sleeve. Also, other known sealing elements may be added to the annular barrier surrounding the outermost safety sleeve to improve sealing properties of the annular barrier.

Also, the outermost safety metal sleeve may be made from or comprise a sealing metal material. If additional sealing elements surrounding the outermost safety metal sleeve are inappropriate for other reasons such as limited space in the annulus, the outermost safety metal sleeve may be made from a material having good sealing properties such as high ductility.

Also, the annular barrier may comprise restricting a free expansion of the sleeves.

The expandable metal sleeve 7 and the additional safety metal sleeves 8, 9, 10 may be made from different materials, one having a higher strength and thereby lower ductility than the other material having a lower strength but higher ductility. Hereby, the annular barrier may comprise the materials adapted to provide high strength or high ductility in a preferred combination. Once expanded, the overall effect is an annular barrier with a higher collapse resistance and higher resistance towards rupture during expansion.

Also, the metal used for the sleeves may have an elongation of 10-35%, preferably 25-35%. The metal may have a yield strength (cold worked) of 500-1000 MPa, preferably 500-700 MPa. The sleeves may be a cold-drawn or hot-drawn tubular structure.

The thickness of the expandable metal sleeve may preferably be at least 10% greater than the thickness of the safety metal sleeves, and more preferably at least 15% greater than the thickness of the safety metal sleeves, and even more preferably at least 20% greater than the thickness of the safety metal sleeves.

The thickness of the safety metal sleeve may be 0.5 mm to 5 mm, and the thickness of the expandable metal sleeve may be 5 mm to 20 mm.

Furthermore, the safety metal sleeves may preferably be made from a material having an elongation of more than 10% of an elongation of the material of the expandable metal sleeve.

The annular barrier may preferably comprise an expandable metal sleeve made from a material having a yield strength which is at least 10% higher than a yield strength of a material of the first and/or second safety metal sleeve, or more preferably at least 15% higher and even more preferably at least 20% higher than a yield strength of the material of the first and/or second safety metal sleeve.

Also, the expandable metal sleeve may have an unexpanded outside diameter and an expanded outside diameter, the expanded diameter of the expandable metal sleeve being at least 10% larger than the unexpanded diameter, preferably at least 15% larger than the unexpanded diameter, and more preferably at least 30% larger than the unexpanded diameter.

Although the invention has been described in the above in connection with preferred embodiments of the invention, it will be evident for a person skilled in the art that several modifications are conceivable without departing from the invention as defined by the following claims.

The invention claimed is:

1. An annular barrier to be expanded in an annulus between a well tubular structure and an inside wall of a borehole downhole for providing zone isolation between a first zone and a second zone of the borehole, comprising a tubular part for mounting as part of the well tubular structure, an expandable metal sleeve surrounding the tubular part to contain expansion pressure and having an inner face facing the tubular part and an outer face facing towards the inside wall of the borehole, each end of the expandable metal sleeve being connected with a connection part which is connected with the tubular part, a space between the inner face of the expandable metal sleeve and the tubular part, and an expansion opening in the tubular part through which fluid may enter into the space in order to expand the expandable metal sleeve by fluid pressure, wherein the annular barrier further comprises a first safety metal sleeve surrounding the tubular part to reinforce the expandable metal sleeve against rupture during application of the expansion pressure, such that the expandable metal sleeve continues to contain the expansion pressure, said first safety metal sleeve having a first inner face directly abutting the outer face of the expandable metal sleeve, each end of the first safety metal sleeve being connected with the connection part which is connected with the tubular part, and wherein the first safety metal sleeve comprises substantially homogenous material.

2. An annular barrier according to claim 1, further comprising a second safety metal sleeve surrounding the tubular part, each end of the second safety metal sleeve being connected with the connection part which is connected with the tubular part.

3. An annular barrier according to claim 2, wherein the safety metal sleeve closest to the inside wall of the borehole is made from a sealing metal material.

4. An annular barrier according to claim 2, wherein the safety metal sleeve closest to the inside wall of the borehole comprises at least one sealing element.

5. An annular barrier according to claim 2, wherein the second safety metal sleeve has an outer surface adapted to contact the inside wall of the borehole.

6. An annular barrier according to claim 2, wherein the first safety metal sleeve has a weak area, the second safety metal sleeve has a weak area, and the expandable metal sleeve has a weak area that is offset from the weak area of the first safety metal sleeve and offset from the weak area of the second safety metal sleeve.

7. An annular barrier according to claim 2, further comprising a third safety metal sleeve, each end of the third safety metal sleeve being connected with the connection part which is connected with the tubular part.

8. An annular barrier according to claim 1, further comprising a plurality of additional safety metal sleeves surrounding the tubular part, and wherein the additional safety metal sleeves are connected with the connection part which is connected with the tubular part.

9. An annular barrier according to claim 8, wherein an additional sealing element surrounding an outermost safety sleeve comprises an intermediate layer of elastomer, rubber or polymer arranged between the outermost safety metal sleeve and a sealing element sleeve.

10. An annular barrier according to claim 1, wherein the expandable metal sleeve and the first safety metal sleeve have different required expansion pressures.

11. An annular barrier according to claim 1, wherein the expandable metal sleeve and the first safety metal sleeve are made from different materials.

12. An annular barrier according to claim 1, wherein each said sleeve has a thickness and the thickness of the expandable metal sleeve is greater than the thickness of the first safety metal sleeve.

13. An annular barrier according to claim 1, wherein the first safety metal sleeve has a higher ductility than the expandable metal sleeve.

14. An annular barrier according to claim 13, wherein the first safety metal sleeve is made of a material having an elongation of more than 10% of an elongation of the material of the expandable metal sleeve.

15. An annular barrier according to claim 1, wherein the expandable metal sleeve has a higher yield strength than the first safety metal sleeve.

16. An annular barrier according to claim 1, wherein the first safety metal sleeve has an outer surface adapted to contact and seal against the inside wall of the borehole.

17. An annular barrier according to claim 1, wherein a cross-sectioned thickness of the first safety metal sleeve is substantially constant from one connection part to the other connection part.

18. An annular barrier according to claim 1, wherein the first safety metal sleeve has a substantially constant cross section.

19. An annular barrier according to claim 1, wherein the expandable metal sleeve and the first safety metal sleeve have ends that are coterminous within the respective connection part.

20. An annular barrier according to claim 1, wherein the connection part comprises a first ledge overlying the expandable metal sleeve and the first safety metal sleeve to sandwich the expandable metal sleeve and the first safety metal sleeve to the tubular part, and wherein the expandable metal sleeve and the first safety metal sleeve have ends that are coterminous underneath the first ledge of the connection part.

21. An annular barrier according to claim 1, wherein the first inner face of the first safety metal sleeve directly abuts the whole length of the outer face of the expandable metal sleeve when the first safety metal sleeve and the expandable metal sleeve are in an unexpanded condition.

22. An annular barrier according to claim 1, wherein the first safety metal sleeve has a weak area, and the expandable metal sleeve has a weak area that is offset from the weak area of the first safety metal sleeve.

* * * * *